United States Patent [19]

Johansson

[11] 4,069,833

[45] Jan. 24, 1978

[54] COLLAPSIBLE WIND AND/OR SUNSHADE SCREEN

[76] Inventor: John Valter Johansson, 33 Amynnesvagen, 890 10 Bjasta, Sweden

[21] Appl. No.: 650,503

[22] Filed: Jan. 19, 1976

[30] Foreign Application Priority Data

Feb. 26, 1975 Sweden ..... 7502070

[51] Int. Cl.[2] ..... A45F 1/16

[52] U.S. Cl. ..... 135/4 R; 296/107; 403/85

[58] Field of Search ..... 296/1 B, 107, 108; 135/1 R, 1 A, 4 R, 4 A, 5 R, 7.1 R, DIG. 1; 211/203

[56] References Cited

U.S. PATENT DOCUMENTS

| | | | |
|---|---|---|---|
| 1,097,941 | 5/1914 | Rector | 135/5 R X |
| 2,159,309 | 5/1939 | Betourne | 135/4 R |
| 2,910,078 | 10/1959 | Schunck | 135/7.1 R X |
| 2,960,993 | 11/1960 | Holmstrom | 135/4 R |

FOREIGN PATENT DOCUMENTS

| | | | |
|---|---|---|---|
| 22257/29 | 9/1930 | Australia | 135/7.1 R |
| 1,337,193 | 7/1963 | France | 135/4 R |
| 1,076,339 | 2/1960 | Germany | 135/4 R |
| 1,313,155 | 4/1973 | United Kingdom | 135/4 R |
| 213,494 | 4/1924 | United Kingdom | 135/4 R |

*Primary Examiner*—Werner H. Schroeder
*Assistant Examiner*—Conrad L. Berman
*Attorney, Agent, or Firm*—Smith, Harding, Earley & Follmer

[57] ABSTRACT

A collapsible wind and/or sunshade screen of the type comprising a screen sheet and a stand supporting the sheet. The stand includes a hub and a pair of outer ribs and an intermediary rib kept together at one end at the hub. The ribs are pivotally carried by the hub on axles in parallel relationship and at least approximately perpendicular to the portion of the screen sheet adjacent the hub. The screen includes means interconnected between the outer ribs and the intermediary rib for releasably maintaining the sheet in a fixed stretched condition.

7 Claims, 8 Drawing Figures

COLLAPSIBLE WIND AND/OR SUNSHADE SCREEN

BACKGROUND AND SUMMARY OF THE INVENTION

The present invention refers to a collapsible wind and/or sunshade screen. In particular it relates to such a screen of an easily portable make which is handy to take along on excursions to the country side, either when hitch-hiking or skiing, on a car trip or with any other vehicle etc. It is a primary demand that such a collapsible screen be of low weight and great stability, as well as easy to handle when taken along, in opening up or shutting up after being used, and, if so desired, it should be readily fixed to any foundation, such as the ground proper, ice and snow, or the like. Furthermore, it should require as little space as possible. These demands are in all essential parts fulfilled by the screen in accordance with the invention.

Briefly stated, the screen in accordance with the invention includes a screen sheet and a stand supporting the sheet. The stand includes a hub and a pair of outer ribs and an intermediary rib kept together at one end at the hub. The ribs are pivotly carried by the hub on axles in parallel relationship and at least approximately perpendicular to the portion of the screen sheet adjacent the hub. The screen includes means interconnected between the outer ribs and the intermediary rib for releasably maintaining the sheet in a fixed stretched condition.

BRIEF DESCRIPTION OF THE DRAWINGS

An embodiment of the wind and/or sunshade screen according to the invention is, by way of example, described hereinafter with reference to the annexed drawings, in which.

DETAILED DESCRIPTION OF THE PREFERRED EMBODIMENTS

Figure 1A:
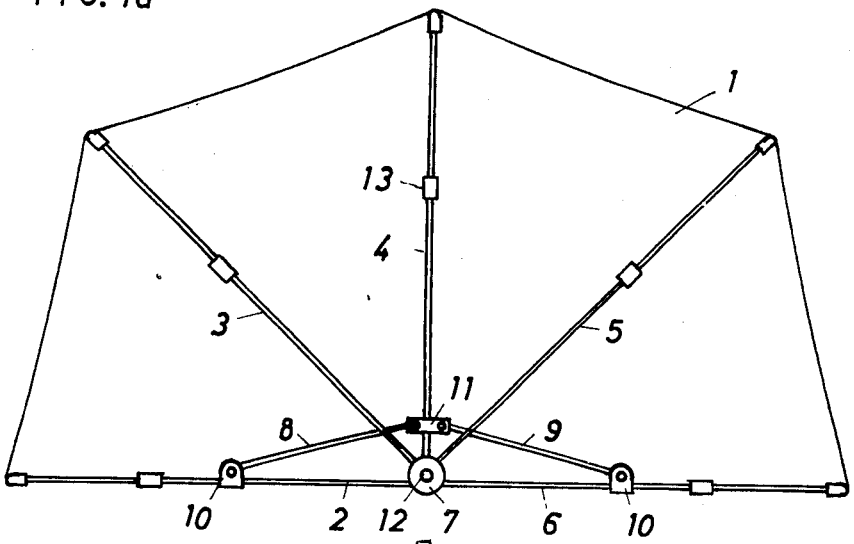
FIGS. 1*a* and 1*b* are diagrammatic front views of two variations of the screen.

The collapsible wind and/or sunshade screen as shown in FIG. 1*a* consists of a screen sheet of textile fabric, plastic foil or any other suitable material and a stand supporting the same and being made up by a number of approximately radially extending ribs 2, 3, 4, 5, 6 joined at their inner ends by a hub 7, and attached at their other outer end, and optionally also at one or several intermediary points, to the screen sheet 1 in a preferably removable manner. The ribs are made to swing to and fro about axles arranged at their inner ends, the axles being parallel inter se and at least approximately perpendicular to the portion of the screen adjacent to the hub or to a plane tangential to said portion.

The screen sheet 1 is kept in extended position by means of a stretching and fixing means comprising two bracing rods 8, 9 clamped in between the central rib 4 and each one of the two outer ribs 2, 6, and in this way together with the extended screen sheet 1 maintaining the ribs 2–6 in their stretched-out position.

The bracing rods 8, 9, are, at their lower end by means of a runner or guide shoe 10, pivotally and slidably connected with the ribs 2, 6 and at their other end by means of another runner or guide shoe 11 both pivotally and slidably connected with the central rib 4. The movement of the runners 10 away from one another along the ribs 2, 6 is limited by stops disposed on said ribs, and the runner 11 is in turn, suitably by means of a lock or hook, fixable in its lowermost position at the rib 4. When shutting up the screen said lock or hook is released and the runner 11 displaced upwards along the rib 4 while simultaneously the runners 10 are displaced towards one another along the ribs 2, 6, so that all ribs can be folded together.

A screen support 12 penetrating the hub 7 and slidable in the same assists in keeping the screen in its upright position on the foundation, and may optionally be arranged to be fastened to the same by means of pegs, clamps or the like. Alternatively, the support 12 may be provided with a projection, for example by being bent in an angle, the projection being inserted in a hole in the ground and used as a fastening means. Such an attachment may be desirable or necessary in stormy weather.

Figure 3:
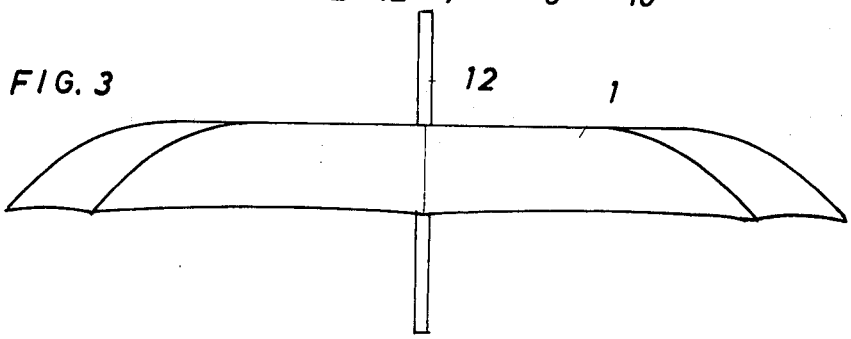
FIGS. 2 and 3 illustrate the screen in a lateral and a top view, respectively.
Figure 2:
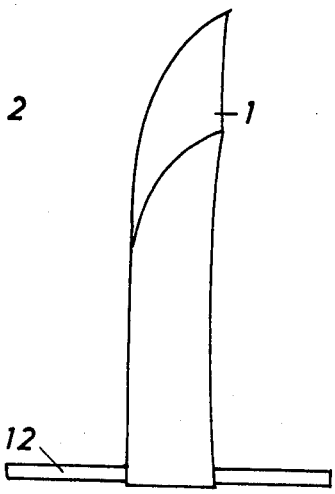

As seen in FIGS. 2 and 3 the ribs are, partly owing to the tension in the screen sheet 1, at their extreme ends inclining or bent in such a manner that the extended screen sheet 1 obtains a concave and convex face, the concave one, when using the screen suitably being set up against the wind. Each rib 2–6 consists of two members, an inner one adjacent to the hub 7, and an outer one. The two members are by means of a link 13 joined in such a manner that the outer end of the rib may be folded towards the convex face of the screen when this is shut up.

Figure 4A:
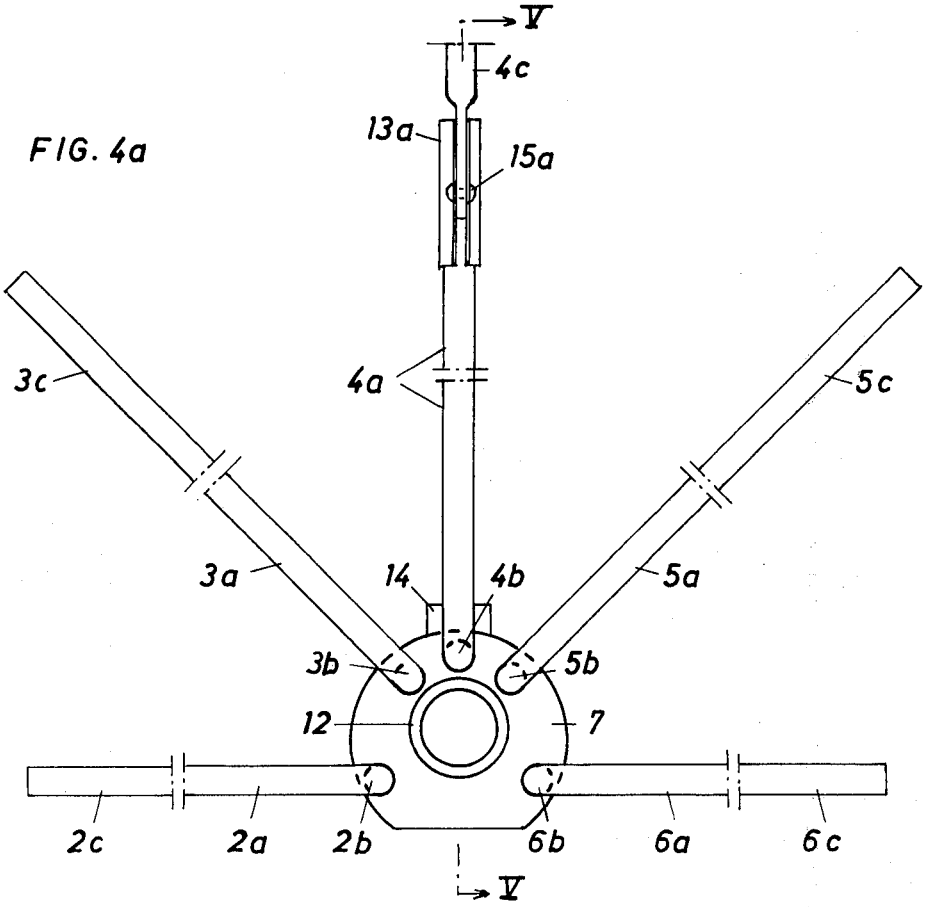
FIGS. 4*a* and 5*a* as well as 4*b* and 5*b* showing details of the carrying members of the screen in a front view and a lateral view, respectively, on a larger scale.
Figure 5A:
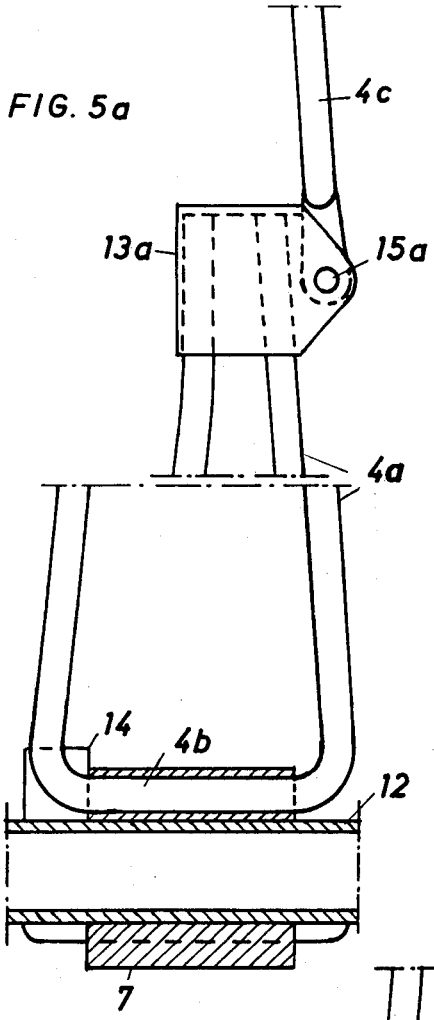

FIGS. 4*a* and 5*a*, of which the latter is a section along line V—V in FIG. 4*a* show in detail, a preferred embodiment of the stand of the screen, only certain parts of the ribs, but not the bracing rods, being shown. The inner parts of the ribs are, as will be seen in FIG. 5*a*, bow-shaped and designated by 2*a*, 3*a*, 4*a*, 5*a*, 6*a*. Each rib bow is with its central portion as an axle pivotally arranged in the hub 7. The central rib 4 is by projections 14 disposed at the hub 7, preferably in its upright position lockable against turning towards the hub 7. The axles formed by the central portions of the rib bows are in FIG. 4*a* designated by 2*b*, 3*b*, 4*b*, 5*b*, 6*b*. These axles are parallel inter se and, at least approximately, perpendicular to the adjacent portion of the screen sheet 1 or to a plane tangential to said portion. The screen support designated 12, consists in this case of a tube centrally inserted in the hub 7. The joint or link 13 between the outer and the inner rib portions 2*c*, 3*c*, 4*c*, 5*c*, 6*c*, and 2*a*, 3*a*, 4*a*, 5*a*, 6*a*, respectively, are formed by a bow- or U-shaped link plate 13*a* and the pertaining pivot 15*a*. The outer and the inner rib portions, in their opened-up position in the axial plane possibly forming an angle inter se, are fixed in said position inter se by the tension in the screen sheet as well as by letting the link plate 13*a* form a stop to the swinging of the outer rib portion in one direction. The outer rib portion is at its extreme end, or possibly in its total length removably attached to the screen sheet, thus facilitating the handling of the screen sheet, when the screen is folded together.

The modification of the collapsible wind and/or sunshade screen illustrated in FIG. 1*b* also consists of a screen sheet 1 of textile fabric, plastic foil or any similar suitable material and a stand supporting the same and formed by a number of at least essentially radially extending ribs 2, 3, 4, 5, 6, which are at their inner end kept together by a hub 7*a*, the making of which is distinct from the one shown in FIGS. 4*a* and 5*a*, and which will be described more in detail with reference to FIGS. 4*b* and 5*b*. At its other, extreme end and optionally also at one or several intermediary points the ribs 2–6 are removably attached to the screen sheet 1. In this case, as well the ribs are pivotal to and fro inter se about axles arranged at their inner ends, which axles are parallel inter se and, at least approximately, perpendicular to the screen sheet portion adjoining the hub or to a plane tangential to said portion.

Figure 1B:
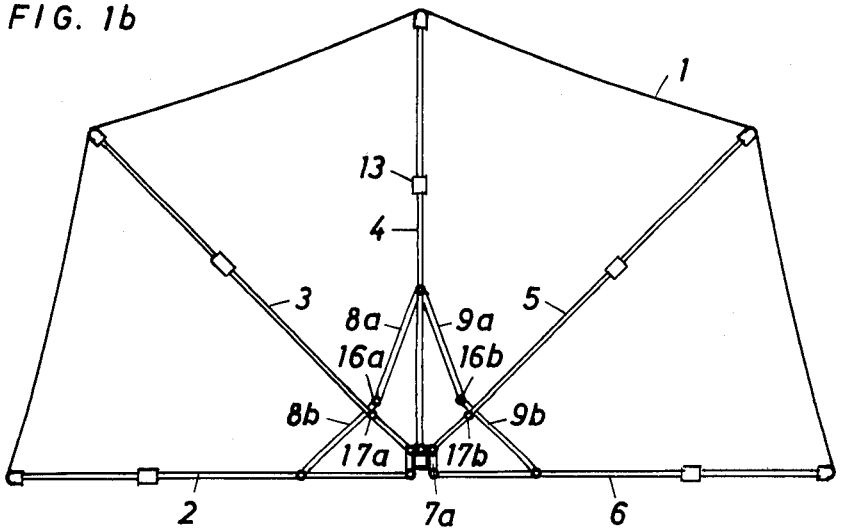

However, in this case, the bracing or tentering rods are made as joint levers, and hence each formed by two rods 8*a*, 8*b* and 9*a*, 9*b*, respectively, which rods at their one end are connected to one another in pairs by a link 16*a* and 16*b*, respectively as shown in FIG. 1*b*. The rods 8*a*, 9*a* are at their other end articulated to the central rib 4, and the rods 8*b*, 9*b* are at their other end articulated to the outer ribs 2 and 6, respectively. Stops 17*a*, 17*b* provided on the intermediary ribs 3 and 5 prevent the link from swinging out further in one direction after just having passed the idle center position. When the links 16*a*, 16*b* are swung into the opposite direction past the central position, the tentering and fixing means will be released in a manner known per se, so that the ribs may be folded towards one another in order to shut up the screen. A tubelike screen support 12 of square cross section and passing through the hub and displaceable in the same also in this case assists in maintaining the screen in its upright position on the foundation.

Figure 4B:
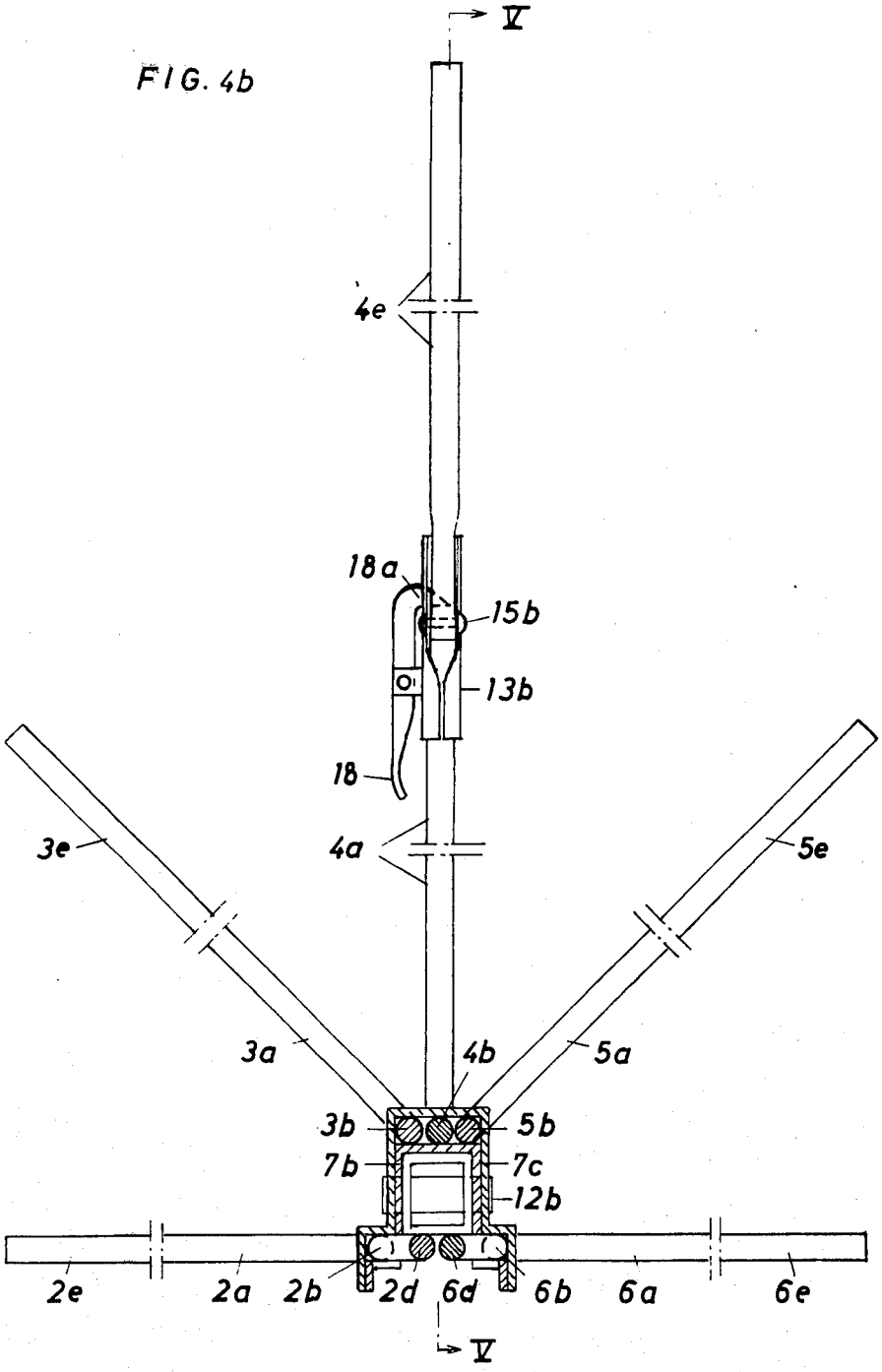
Figure 5B:
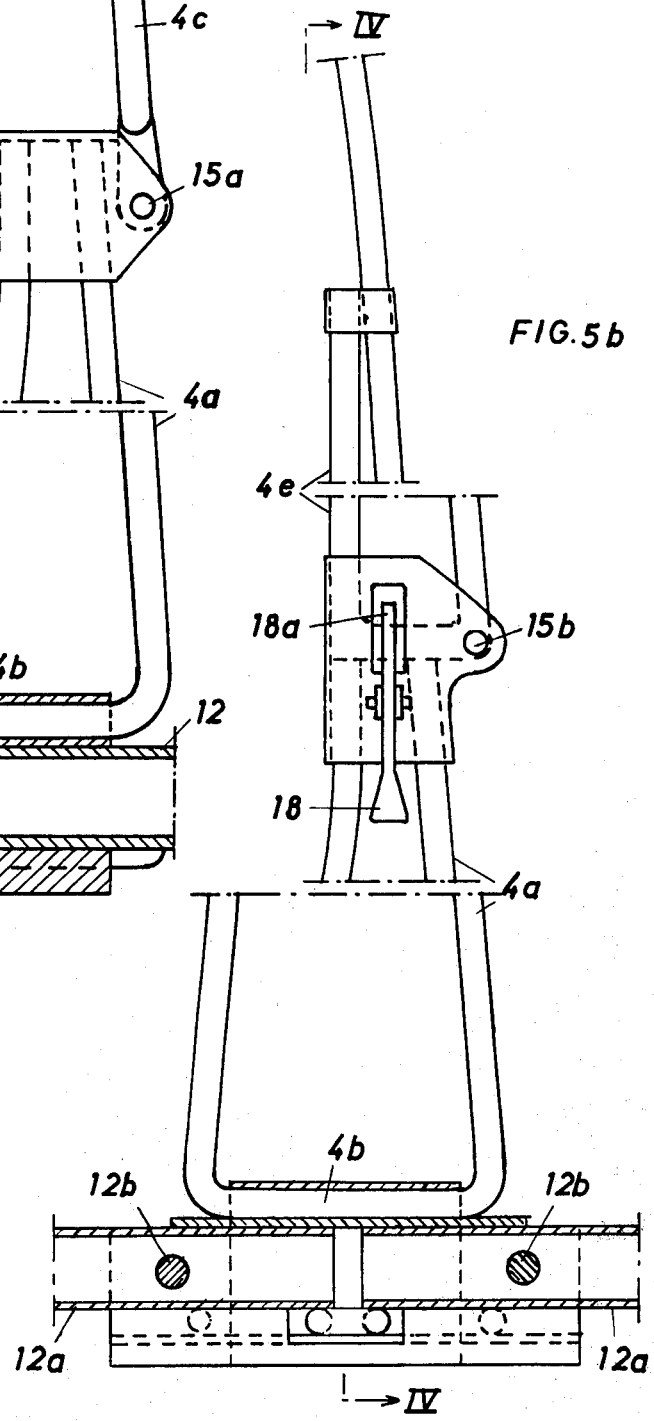

FIGS. 4*b* and 5*b*, which are partial sections along lines IV—IV and V—V in FIGS 5*b* and 4*b*, respectively, illustrate details of still another embodiment of the stand of the wind and/or sunshade screen according to the invention. The inner rib members are also in this case, as seen in FIG. 5*b*, bow-shaped and designated 2*a*, 3*a*, 4*a*, 5*a*, 6*a*. Each bow is at its central part pivotally carried between two plates 7*b*, 7*c*, likewise bent into a bow and forming the hub 7*a*, the plates 7*b*, 7*c* being inserted in one another and suitably joined by welding.

The bow center portions of the central ribs 3, 4, 5 are in this case placed at the upper end of the hub 7*a* and adjoining one another between the center portions of the bow plates 7*b*, 7*c*, while the bow center portions of the outer ribs 2, 6 are placed at the lowermost part of the hub 7*a* and between the extreme ends of the bow plates legs. The rib bows center portions hence form pivoting axles 2*b*, 3*b*, 4*b*, 5*b*, 6*b*, which are also in this case parallel inter se and at least approximately perpendicular to the adjacent portion of the screen sheet 1. The screen support in this case consists of two square tubelike portions 12*a* whose adjacent ends extend into the space inbetween the legs of the inner bow 7*b* and pivotally bear on one cross bar 12*b* each. The screen support members 12*a* can in this way be swung up so that they be essentially parallel to the main direction of the rib 4. In their swung out position, the members 12*a* are blocked by projections 2*d*, 6*d* extending from the central portion of the rib bows 2*a*, 6*a* and formed by said central portion with the ribs opened up in the manner shown in FIG. 4*b*.

The outer portions of the ribs 2*e*, 3*e*, 4*e*, 5*e*, 6*e* are in this case as well bow-shaped, as seen in FIG. 5*b*. They are by means of a link plate 13*b* attached to the adjacent end of the rib inner portions 2*a*, 3*a*, 4*a*, 5*a*, 6*a* and by means of an axle 15*b* passing through the end link plate 13*b* and the rib bow collapsibly connected to the rib inner portions and are maintained in their opened up position by means of a spring-loaded catch 18*a* cooperating, through a hole in the link plate 13*b* with the central portion of the bow-shaped rib and releasable by means of an arm 18. The one leg of the bow-shaped outer rib portion, which leg is suitably considerably longer than the other one, is preferably by its total projecting portion or, at least, at its ends suitably removably, attached to the screen sheet 1, thus facilitating the handling of the same when folding the screen together.

Further modification may be considered within the scope of the invention. Hence may, for example, all the ribs may be borne co-axially on a common, optionally tubelike axle embracing the screen support and forming the hub, the inner ends of the ribs being made as loops or the like enclosing said axle.

I claim:

1. A collapsible wind and/or sunshade screen comprising:

a cover, a stand supporting said cover including two outer ribs mounted for movement to an opened up position in which said outer ribs are located in a common plane which is at least substantially perpendicular to said cover, at least one intermediary rib positioned between said outer ribs, said ribs being secured to said cover for positioning the same in a collapsed condition and in stretched condition forming a screen, said ribs having axles at their one end, a hub receiving said axles for holding said ribs together at said one end thereof to extend radially from said hub, said axles being approximately perpendicular to the portion of said cover near said hub, said ribs being pivotally movable about said axles received in said hub for movement relative to one another for moving said cover from the collapsed condition to the stretched condition, means interconnected between said outer ribs and said intermediary rib for moving said ribs to a separated position to maintain said cover in said stretched condition, and an elongated screen support for holding the screen in an upright position on a foundation and to counteract the upsetting thereof, said screen support being arranged to penetrate into said hub and to extend on an axis approximately perpendicular to the portion of said cover near said hub, said screen support penetrating said hub at approximately the same level as the axles of said outer ribs, said screen support having portions extending a substantial distance on both sides of said cover, said screen support comprising two portions pivotally connected with the hub, the pivoting axles of said portions being at least approximately parallel inter se and perpendicular to said axles of the ribs.

2. A collapsible wind and/or sunshade screen according to claim 1, in which said rib interconnecting means comprises two bracing rods each of which is pivotally and displaceably connected at its ends to the intermediary rib and to one of the outer ribs.

3. A collapsible wind and/or sunshade screen according to claim 1, in which said rib interconnecting means comprises two bracing rods, each of which is formed by two articulated rods acting like joint levers, one of said bracing rods being articulated to the intermediary rib and the other one of said bracing rods being articulated to one of the outer ribs.

4. A collapsible wind and/or sunshade screen according to claim 1, in which said ribs are bent at least along part of their length and said cover is formed in such a way that the screen obtains one concave and one convex face when moved to said stretched condition.

5. A collapsible wind and/or sunshade screen according to claim 1, wherein said two screen support portions are arranged in their opened up position to be essentially on either side of said cover and in this position to be blocked by projections provided at said outer ribs.

6. A collapsible wind and/or sunshade screen according to claim 1, wherein each rib comprises two members articulated inter se and provided with a releasable catch, the articular axle of said members being at least approximately perpendicular to the rib hub axle.

7. A collapsible wind and/or sunshade screen according to claim 1, wherein each rib consists of two members insertable longitudinally inter se and including a releasable locking device for holding said members in a pulled out position.

* * * * *